US007638697B2

(12) United States Patent
Moore

(10) Patent No.: US 7,638,697 B2
(45) Date of Patent: Dec. 29, 2009

(54) APPARATUS FOR COUPLING STRINGS TO THE BODY OF A STRINGED INSTRUMENT AND RELATED METHODS

(76) Inventor: Kevin S. Moore, 991 Sumac Dr., Logan, UT (US) 84321

( * ) Notice: Subject to any disclaimer, the term of this patent is extended or adjusted under 35 U.S.C. 154(b) by 199 days.

(21) Appl. No.: 11/266,807

(22) Filed: Nov. 3, 2005

(65) Prior Publication Data

US 2007/0095192 A1 May 3, 2007

(51) Int. Cl.
*G10D 3/04* (2006.01)
*G10D 1/00* (2006.01)
*G10D 3/12* (2006.01)

(52) U.S. Cl. ..... 84/298; 84/173; 84/297 R; 84/299

(58) Field of Classification Search ..... 84/173, 84/267, 290, 297 R, 298–301, 305, 307, 308, 84/312 R, 313, 453–455, 167, 168, 458, 450; D17/14, 20, 21, 99
See application file for complete search history.

(56) References Cited

U.S. PATENT DOCUMENTS 4,135,426 A * 1/1979 Rickard ..... 84/743
4,160,401 A * 7/1979 Tomioka ..... 84/731
4,171,661 A * 10/1979 Rose ..... 84/313
4,248,126 A 2/1981 Lieber
4,385,543 A 5/1983 Shaw et al.
4,426,907 A * 1/1984 Scholz ..... 84/454
4,430,919 A * 2/1984 Matsui ..... 84/299
4,625,613 A * 12/1986 Steinberger ..... 84/298
4,649,789 A * 3/1987 Wadatsu ..... 84/298
4,655,116 A * 4/1987 Matsui ..... 84/312 R
4,672,877 A 6/1987 Hoshino et al.
4,688,461 A 8/1987 Stroh
4,843,941 A * 7/1989 Nichols et al. ..... 83/313
4,911,055 A 3/1990 Cipriani
5,052,260 A 10/1991 Cipriani
5,198,601 A 3/1993 McCabe
5,208,410 A 5/1993 Foley
5,285,710 A * 2/1994 Chapman ..... 84/307
5,448,935 A * 9/1995 Kosinar ..... 84/298

(Continued)

OTHER PUBLICATIONS

Moore, "KSM Means Music—Rhythm & News—The Official Newsletter of KSM Music", Mar. 2004 (2 pages).

*Primary Examiner*—Jeffrey Donels
*Assistant Examiner*—Christopher Uhlir
(74) *Attorney, Agent, or Firm*—Traskbritt

(57) ABSTRACT

An apparatus and method are provided for coupling strings to the body of a musical instrument and adjusting such strings. In one embodiment, a base is provided and one or more adjustment assemblies are disposed on a surface of the base including a first structure disposed on the surface of the base and a second structure which is slidably interlocked with the first structure. A first adjustment screw may be disposed between a portion of the base and the first structure such that rotation thereof effects displacement of the first structure and the second structure along a first axis relative to the base. A second adjustment screw may be disposed between the first and second structures such that rotation thereof effects displacement of the second structure along a second axis relative to the first structure. A clamping mechanism is provided to affirmatively lock the one or more adjustment assemblies relative to the base.

14 Claims, 4 Drawing Sheets

U.S. PATENT DOCUMENTS 5,537,907 A * 7/1996 Rose ..... 84/298
5,600,078 A * 2/1997 Edwards ..... 84/307
6,133,515 A * 10/2000 Hoshino ..... 84/307
6,613,968 B1 9/2003 Devereaux et al.
6,686,523 B1 2/2004 Devereaux et al.
2002/0000152 A1 * 1/2002 Powers ..... 84/298
2002/0092404 A1 * 7/2002 Naimish ..... 84/298

* cited by examiner

APPARATUS FOR COUPLING STRINGS TO THE BODY OF A STRINGED INSTRUMENT AND RELATED METHODS

BACKGROUND OF THE INVENTION

1. Field of the Invention

The present invention relates generally to stringed musical instruments and, more particularly, to apparatuses such as bridges and tail pieces used in conjunction with stringed instruments as well as related methods.

2. State of the Art

Various types of stringed instruments are used to produce music. Such instruments include, for example, violins, cellos, banjos, guitars and basses including numerous variations of each. For example, guitars may include a typical six-stringed guitar, either electric or acoustic, or may include a bass guitar that in some conventional configurations, only includes four or five strings. The strings of an instrument are made to produce a musical sound by performing an act on one or more of the strings such as by drawing a bow across the strings, picking the strings (such as with a user's fingers or with a pick), plucking the strings, strumming the strings or slapping the strings as will be appreciated by those of ordinary skill in the art.

Generally, a stringed musical instrument produces musical sound through vibration of the strings after the strings have been acted upon (e.g., picked or strummed). However, the manner in which a sound is projected by a stringed instrument depends, to a certain extent, on the physical configuration of the instrument itself. For example, a stringed instrument may be classified as a hollow-body instrument (sometimes referred to as an acoustical instrument) or as a solid-body instrument (sometimes referred to as an electrical instrument). Hollow-body and solid-body instruments have different characteristics in projecting the sounds produced by the vibrating strings coupled therewith.

Generally, a hollow-body instrument, such as an acoustical guitar, produces sound by transferring the vibrations of the strings to the top, back and sides of the hollow-body. In essence, the hollow-body becomes and amplifier to project the sounds produced by the vibrating strings. On the other hand, a solid body instrument typically employs an electromagnetic sensor known as a "pick-up" which detects the vibration of each string and produces an electrical signal representative of the string's vibration. The electrical signal is passed to, and processed by, an electric amplifier which projects a sound corresponding with the vibrating string.

Strings are conventionally coupled to a stringed instrument by attaching one end of each string to a tuning peg located on a headstock of the instrument, passing a portion adjacent the second end of the string over a bridge component and attaching the second end of the string to a tail piece that is coupled to the body portion of the instrument. The specific manner in which the strings are coupled to an instrument, and particularly regarding the bridge, tail piece or both, can substantially affect the resulting playing characteristics and sound projection of the instrument.

For example, the distance that the strings are placed above an associated fretboard or fingerboard can be an important consideration for individual musicians depending, for example, on the size and strength of their hands and the reach of their fingers. Additionally, regardless of the physical characteristics of their hands, some players may have a preference for having the strings of an instrument either closer to or further away from the fret board so as to provide a specific action or feel to the instrument. Thus, the ability to adjust and have precise control over string height is an important factor to musicians in selecting and using a particular instrument. The string height of an instrument is largely determined by the bridge component of a conventional stringed instrument.

Additionally, the manner in which strings are attached to an instrument determine that manner in which the instrument is tuned or the manner in which precise intonation adjustments are made. Bridge components, tail components or a combination of both components may also be used in making intonation adjustments to the strings of an instrument.

Bridges for stringed instruments are available in numerous configurations including those which are relatively unadjustable, bridges having limited adjustability wherein adjustment of the bridge with respect to one string in an interdependent adjustment of other strings, and bridges where individual components are provided for the independent adjustment of each individual string. Examples of various bridge and tail piece designs known in the art include those which are described in U.S. Pat. Nos. 6,686,523 and 6,613,968 issued to Devereaux et al., U.S. Pat. No. 4,911,055 issued to Cipriani, and U.S. Pat. No. 4,385,543 issued to Shaw et al.

One example of a bridge component for a stringed instrument that provides both height adjustability and intonation adjustment is described in U.S. Pat. No. 5,600,078 issued to Edwards, the disclosure of which is incorporated by reference herein in its entirety. Edwards describes a bridge having a base and an intonation adjustment member that is slidably mounted on the base for adjusting the horizontal position at which a string is supported by the bridge. A height adjustment member is slidably mounted on the intonation adjustment member for adjusting the vertical position of the string above the body of the instrument. The intonation adjustment member includes a ramp portion for slidably supporting the height adjustment member while maintaining substantially constant contact surface area between the two members. The intonation member interlocks with the base and the height adjustment member interlocks with the intonation adjustment member.

While providing adjustability with respect to string height, intonation adjustment or both, the manner in which the strings of an instrument are coupled to its body can also have a substantial impact on the quality of the sound be produced by such strings. For example, with solid-body instruments, the design of a bridge and tail piece has a substantial impact on various qualities of the sound being produced by the strings including the tone and the sustain of the instrument. The ability of an instrument to reproduce sounds at the correct tone is vital to the quality of an instrument. The sustain of an instrument generally refers to the ability of the strings to maintain vibration for an extended period of time. Generally, musicians prefer stringed instruments that exhibit extended sustain because of the flexibility in allowing a note, chord or sound produced by a string to continue indefinitely, if desired, or to manually terminate the sound by purposefully damping the strings.

Unfortunately, the versatility provided by conventional adjustability of the strings, such as by way of an adjustable bridge, can negatively impact the sustain of an instrument and, due to the numerous individual parts, can cause the strings of the instrument to become out of tune excessively. In other words, various factors such as loose or worn bridge components (which may include structural components, fasteners and adjusting actuators), the manufacturing tolerances inherent in such components, and the accumulation of dirt and debris on or in between such components, can individually or cumulatively result in the damping of a string's vibration and, thus, severely weaken the sustain of a stringed musical instrument. Such damping, in effect, results in poor transfer of vibration and string energy into the body of the stringed instrument thereby negatively impacting the musical performance of the instrument.

In view of the shortcomings in the art, it would be advantageous to provide an improved apparatus and method for coupling strings to a stringed instrument. Such an apparatus and method may desirably provide effective adjustability of the strings while also providing increased transfer of string energy to the body of the instrument. Additionally, such an apparatus and method may also desirably provide flexibility in coupling of strings to the body of numerous types of instruments including solid-body instruments, hollow-body instruments, and instruments utilizing any number of strings.

BRIEF SUMMARY OF THE INVENTION

In accordance with one aspect of the present invention, an apparatus is provided for coupling strings to a body of a musical instrument. The apparatus includes a base having a plate and at least one adjustment assembly. The at least one adjustment assembly includes a first structure disposed on a surface of the plate and a second structure slidingly interlocked with the first structure. A surface of the second structure defining a saddle for a string. A first adjustment screw is threadably coupled to the first structure and configured to displace the first structure along a first axis upon rotation of the first adjustment screw. A second adjustment screw is disposed between the first structure and the second structure, the second adjustment screw being configured to displace the second structure along a second axis relative to the first structure upon rotation thereof. The apparatus further includes at least one clamping member sized and configured to be releasably coupled with the base and configured to affirmatively restrain the movement of at least one of the first structure along the first axis and the second structure along the second axis.

In accordance with another aspect of the present invention, a musical instrument is provided. The musical instrument includes a headstock, a neck coupled with the headstock, wherein a surface of the neck defines a fingerboard, a body coupled with the neck and at least one string extending between the headstock and the body. The musical instrument further includes a coupling apparatus disposed on a portion of the body and coupled to the at least one string. The coupling apparatus includes a base having a plate and at least one adjustment assembly.

The at least one adjustment assembly includes a first structure disposed on a surface of the plate and a second structure slidingly interlocked with the first structure. A surface of the second structure defining a saddle for a string. A first adjustment screw is threadably coupled to the first structure and configured to displace the first structure along a first axis upon rotation of the first adjustment screw. A second adjustment screw is disposed between the first structure and the second structure, the second adjustment screw being configured to displace the second structure along a second axis relative to the first structure upon rotation thereof. The coupling apparatus further includes at least one clamping member sized and configured to be releasably coupled with the base and configured to affirmatively restrain the movement of at least one of the first structure along the first axis and the second structure along the second axis.

In accordance with yet another aspect of the present invention, a method is provided for adjusting at least one string on a stringed musical instrument. The method includes coupling a base to a body of the instrument and providing at least one adjustment assembly including disposing a first structure on a surface of the base, slidably coupling a second structure with the first structure and defining a surface of the second structure as a saddle for the at least one string. A portion of the at least one string is disposed over the saddle and the height of the at least one string is adjusted relative to the base by displacing the second structure relative to the first structure along a first axis. The free length of the at least one string is adjusted by displacing the first structure and the second structure along a second axis. The first structure and the second structure are affirmatively locked relative to the base.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
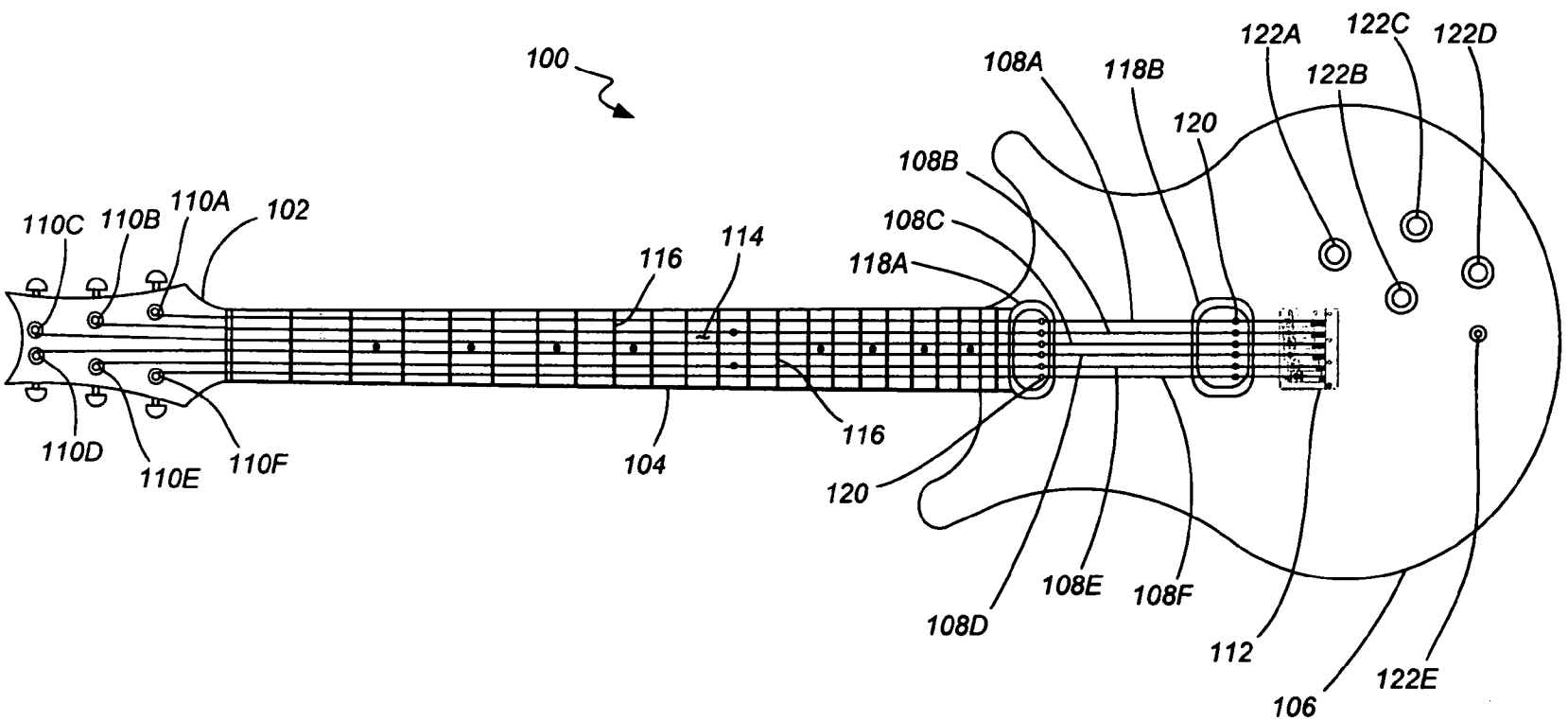
FIG. 1 is a plan view of a stringed instrument in accordance with one embodiment of the present invention.

Referring to FIG. 1, a stringed musical instrument 100 is shown in accordance with an embodiment of the present invention. The instrument 100 includes a headstock 102 integral with or otherwise coupled to a neck 104. The neck 104 may be integral with or otherwise coupled with a body 106 of the instrument 100. The body 106 of the instrument 100 may include a solid-body design (i.e., the body 106 is substantially devoid of an internal cavity) as may be associated with, for example, electric guitars and electric bass guitars, or it may include a hollow-body design (i.e., the body 106 defines an internal cavity) as may be associated with various so-called acoustical instruments.

A plurality of strings 108A-108F extend from the headstock 102 to the body 106. It is noted that the designation of strings "A-F" is simply for convenience and that such designations are not indicative of any particular musical note. The strings 108A-108F each have a first end that is coupled to an individual tuning peg 110A-110F associated with the headstock 102 and a second end that is attached to a coupling apparatus 112 associated with the body 106. Although the embodiment shown and described with respect to FIG. 1 includes six individual strings 108A-108F, it will be appreciated by those of ordinary skill in the art that more strings or fewer strings may be used depending on the type and nature of the musical instrument.

A surface of the neck 104 underlying the strings 108A-108F is configured as a fingerboard 114 (sometimes referred to as a fretboard). During use of the instrument 100 a musician may depress one or more of the strings 108A-108F against the fingerboard 114 to effectively alter the free length of the strings 108A-108F and thereby selectively define the note that is to be produced by a given string 108A-108F when acted upon (e.g., struck, strummed, picked or plucked) as will be appreciated by those of ordinary skill in the art. A plurality of frets 116 may be disposed in or on the fingerboard 114 to assist in defining the note to be played by a given string 108A-108F. As will be appreciated by those of skill in the art, the frets 116 may include substantially elongated members that protrude slightly above the surface of the fingerboard 114 and longitudinally extend across the fingerboard 114 substantially transverse to the longitudinal direction of the strings 108A-108F.

The instrument 100 may further include one or more pickup devices 118A and 118B having a plurality of electromagnetic coils 120 (for example, one coil 120 being associated with each string) to reproduce and amplify the vibration of the strings 108A-108F through an electric amplifier (not shown). It is noted that a variety of pickup devices are known and available and that the present invention is not limited to use of any specific pickup device. Additionally, the present invention is not limited to the use of any particular number of pickup devices in a given instrument.

The instrument 100 may also include any number of controls 122A-122E that may be operatively coupled with the pickup devices and configured to alter the signal produced by the pickup devices 118A and 118B. Such controls 122A-122E may include, for example, volume and tone controls as well as toggle switches that may selectively enable the operation of a given pickup device 118A or 118B or a combination of such pickup devices 118A and 118B. Also, while not shown, the instrument 100 includes an outlet (or an output jack) configured to couple the instrument with an electric amplifier or other processing device for transfer of the electrical signals produced by the pickup devices 118A and 118B.

The instrument 100 may include various other features, not specifically shown, which are known to those of ordinary skill in the art. Such features may include, for example, a pick guard on the surface of the body 106 to prevent scratching of the body's finish or hardware coupled to the body 106 for connecting a strap to the instrument 100.

Figure 2:
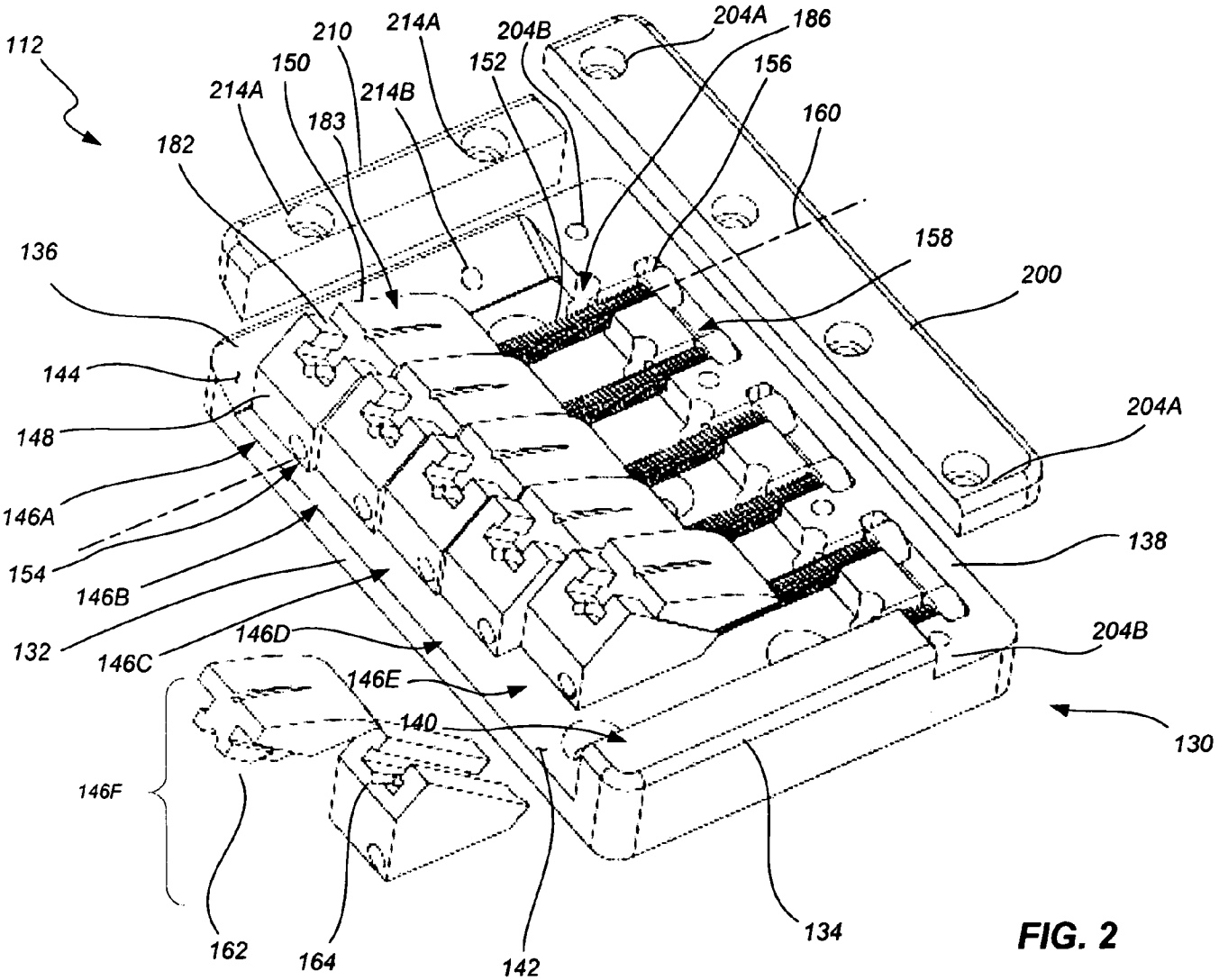
FIG. 2 is a semi-exploded perspective view of a bridge for a stringed instrument in accordance with an embodiment of the present invention.
Figure 3:
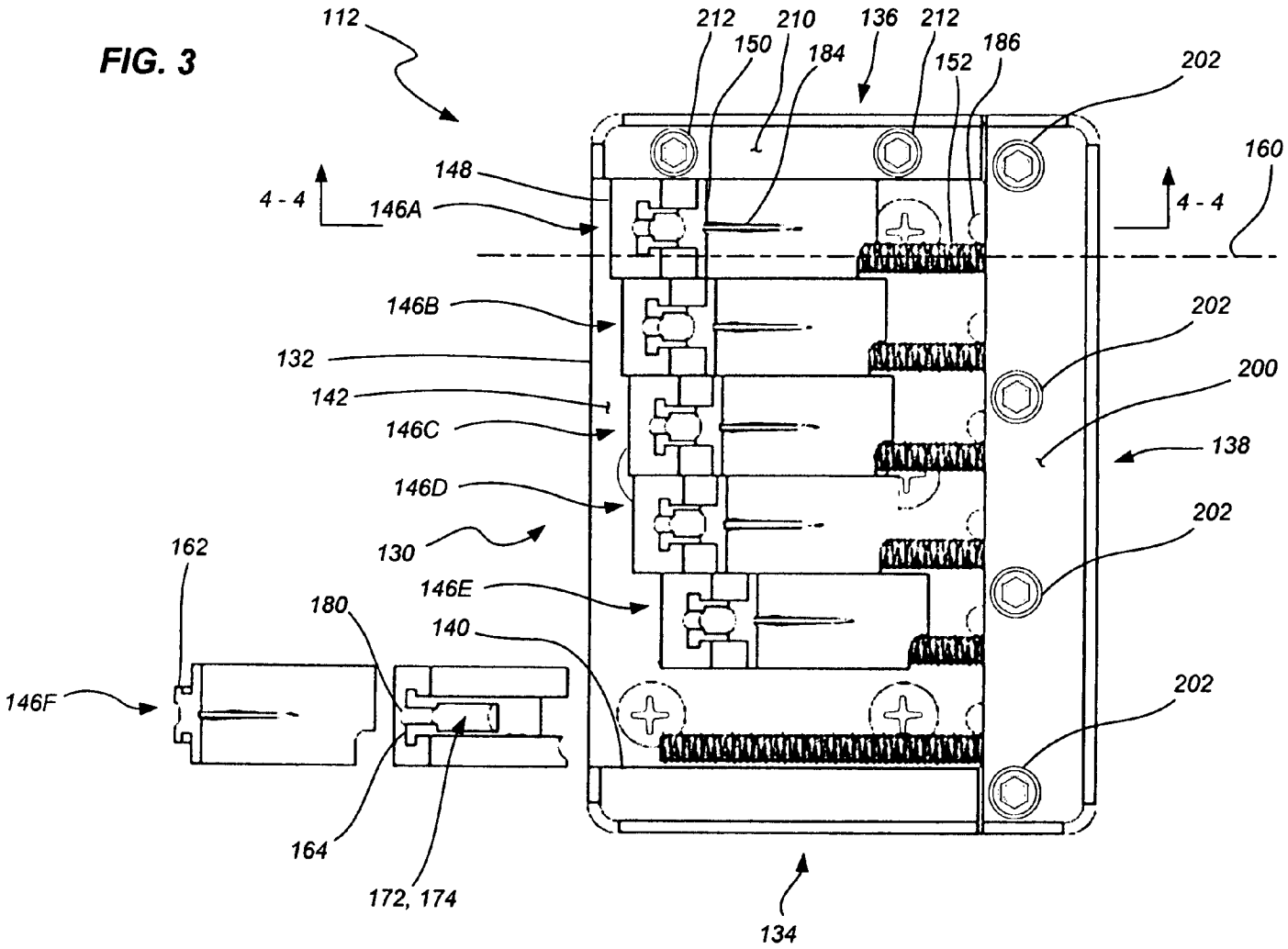
FIG. 3 is a plan view of the bridge shown in FIG. 2.

Referring now to FIGS. 2 and 3 while maintaining general reference to FIG. 1, a coupling apparatus 112 is shown and described in accordance with one embodiment of the present invention. It is noted that FIG. 2 shows a perspective and semi-exploded view of the coupling apparatus 112 while FIG. 3 shows a plan view of the same coupling apparatus 112 in a substantially assembled condition.

The coupling apparatus 112 includes a base 130 having a plate 132, a first side wall 134, a second side wall 136 and an end wall 138. In one embodiment, the side walls 134 and 136 and the end wall 138 may be integrally formed with the plate 132 and with each other as a substantially homogenous member such as by casting, molding, forging, or by machining from a single piece of stock material. In one particular embodiment, the base 130 may be formed as a single machined component from a substantially rigid metal or metal alloy such as, for example, 6061 or 7075 aluminum. In such an embodiment, the aluminum may be anodized for protection of the components as well as to provide a desired appearance. Of course other materials are contemplated as being suitable.

In another embodiment, the side walls 134 and 136 and the end wall 138 may be fastened to the plate 132 and to each other by various means such as with mechanical fasteners, by welding or by a combination of various techniques as will be appreciated by those of ordinary skill in the art. In yet another embodiment, the plate 132, the side walls 134 and 136 and the end wall 138 may simply be fixed relative to each other by proper attachment of each individual piece to the instrument's body 106.

In the embodiment shown in FIGS. 2 and 3, the side walls 134 and 136 are configured to longitudinally extend substantially parallel to one another. The first side wall 134 may include an internal surface 140 which is substantially perpendicular to the upper surface 142 of the plate 132. The second side wall 136 may include an internal surface 144 that exhibits an acute angle (i.e., other than a substantially perpendicular angle) relative to the upper surface 142 of the plate 132.

The coupling apparatus 112 further includes a plurality of string adjustment assemblies 146A-146F. Each of the string adjustment assemblies 146A-146F includes similar structures and components and, therefore, only one string adjustment assembly 146A is discussed in detail for purposes of brevity and clarity. The string adjustment assembly 146A includes a first structure, which is referred to herein as an intonation adjustment structure 148, and a second structure, which is referred to herein as a string height adjustment structure 150, that is coupled with the intonation adjustment structure 148 as will be described in greater detail hereinbelow. The intonation adjustment structure 148 is disposed on and configured to slide along the upper surface 142 of the base 130.

An adjustment actuator, such as an adjustment screw 152 having machined threads, may threadably engage a channel or aperture 154 formed in the body of the intonation adjustment structure 148. The adjustment screw 152 includes a portion, such as a head 156, that is disposed within a channel 158 formed in the end wall 138. The head 156 and channel 158 are cooperatively sized and configured to restrain the adjustment screw 152 from being displaced in a direction along its longitudinal axis 160 while enabling it to rotate about its longitudinal axis 160. As the adjustment screw 152 is rotated about its longitudinal axis 160 it causes the intonation adjustment structure 148 (and consequently the height adjustment structure 150 coupled therewith) to be displaced in a direction extending along the longitudinal axis 160 of the adjustment screw 152. The adjustment screw 152 may be actuated, or rotated about its longitudinal axis 160, such as by manipulating the head 156 by hand or with a tool. In another embodiment, a tooled recess may be formed in an end of the adjustment screw 152 opposite the head 156 and a tool, such as a hex head tool (not shown), may be inserted into the aperture 154 and matingly engage the adjustment screw 152 for actuation thereof.

Figure 4:
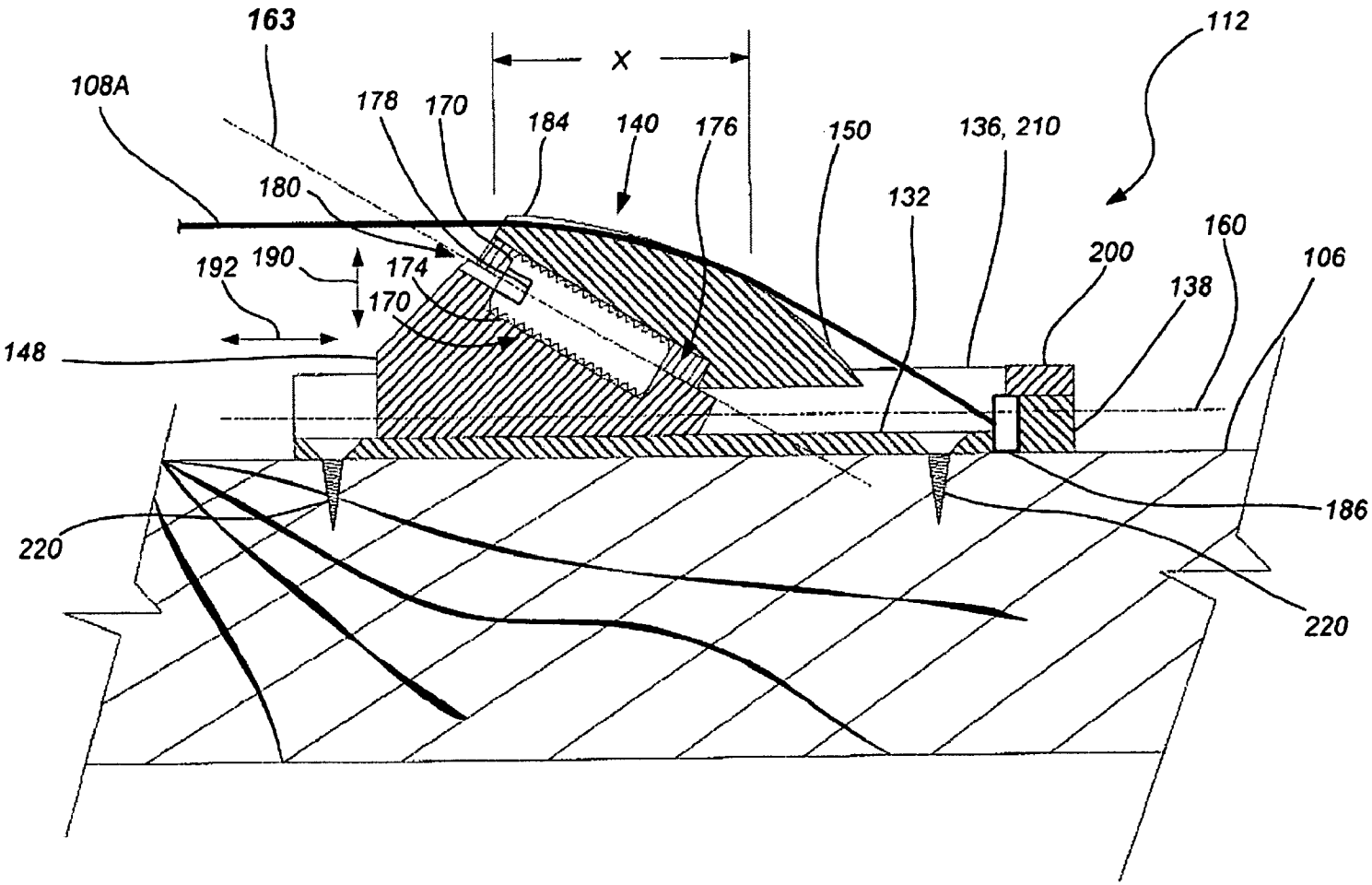
FIG. 4 is a partial cross-section view of various components of a bridge as taken along the section lines shown in FIG. 3.

The height adjustment structure 150 is slidingly interlocked with the intonation adjustment structure 148 such that the height adjustment structure 150 can only be bidirectionally displaced along axis 163 (as best seen in FIG. 4) relative to the intonation adjustment structure 148. The sliding interlock of the string height adjustment structure 150 and the intonation adjustment structure 148 may include, for example, a flanged protrusion 162 formed on the string height adjustment structure 150 disposed in a cooperatively mating recess or channel 164 formed in the intonation adjustment structure 148, or vice versa, as best seen in the exploded view of adjustment assembly 146F. It is noted that, in another embodiment, the intonation adjustment structure 148 may have a similar interlocking relationship with the plate 132 if so desired.

As seen in FIG. 4, an adjustment actuator, such as an adjustment screw 170 with machined threads, may be disposed in a cavity 172 cooperatively defined by the height adjustment structure 150 and the intonation adjustment structure 148. The cavity 172 may include an unthreaded portion 174 formed in the intonation adjustment structure 148 and a threaded portion 176 formed in the height adjustment structure 150. Abutments at each longitudinal end of the unthreaded portion restrain the adjustment screw 170 from any substantial displacement along the axis 163 relative to the intonation adjustment structure 148. The adjustment screw 170 threadably engages the threaded portion 176 of the cavity 172 formed in the height adjustment structure 150.

In the embodiment shown and described with respect to FIG. 4, the adjustment screw 170 is disposed within the cavity 172 such that it is substantially concealed from a viewer of the coupling apparatus 112 during normal use thereof. The adjustment screw 170 may include a tooled recess 178 or other structure that may be matingly engaged by an appropriate tool (such as by a hex head tool) inserted through an opening 180 at an end of the cavity 172 to rotate the adjustment screw 170 about its longitudinal axis 163. Because the adjustment screw is restrained from axial movement (i.e., in the direction of axis 163), when the adjustment screw 170 is actuated or rotated it causes the height adjustment structure 150 to be displaced relative to the intonation adjustment structure 148 in a direction parallel to axis 163 along a ramped or angled interface 182 (FIG. 2) formed between the two structures.

Continuing to refer to FIGS. 2 through 4, the upper surface of the height adjustment structure 150 acts as a saddle 183 for an associated string 108A and includes a groove 184 formed therein to act as a seat for the string 108A. The string 108A wraps around a portion of the saddle 183 and establishes contact therewith for a significant distance as indicated by the dimension "X" as seen in FIG. 4. In one embodiment, the string 108A may maintain contact with the saddle 183 for a distance of over ¾ of an inch. The string 108A extends beyond the height adjustment structure 150 and may be anchored in an aperture 186 formed in the base 130 as will be appreciated by those of ordinary skill in the art. While the presently described embodiment exhibits a "through-body" stringing configuration, it is noted that the present invention may readily be configured as a "through-back" stringing configuration by forming apertures in the end wall 138 for the strings to pass through.

When the height of a string 108A needs to be adjusted, the adjustment screw 170 is rotated thereby causing the height adjustment structure 150 to be displaced along axis 163 as discussed above. It is noted that while the term "height adjustment structure" is used herein, that adjustment of such a structure 150 may have a minor effect on the intonation of a string 108A since the displacement of the structure 150 includes a first directional component 190 that is primarily associated with height adjustment and a second directional component 192 that is primarily associated with intonation adjustment.

When the intonation of a string 108A is to be adjusted, the adjustment screw 152 is rotated thereby causing both the intonation adjustment structure 148 and the height adjustment structure 150 (including the saddle 183) to be displaced in a direction parallel to axis 160. Intonation of a string may be altered, at least in part, by altering the free length of the string 108A (i.e., the length of the string between two points of constraint). The saddle 183 acts as a constraining point for the string 108A. Thus, as the saddle 183 is displaced in a direction parallel to axis 160 (which is substantially parallel to the longitudinal extent of the string 108A), the free length of the string 108A is altered thereby adjusting the intonation of the string 108A.

With all of the strings 108A-108F of a musical instrument satisfactorily adjusted (or, in other words, with all of the components of the string adjustment assemblies 146A-146F being positioned to effect satisfactory adjustment of the strings 108A-108F), a first clamping structure 200 may be placed over the heads 156 of the adjustment screws 152 and fastened to the end wall 138 such as by use of appropriate fasteners 202 inserted through and coupled with apertures 204A and 204B formed in the clamping structure 200 and the end wall 138, respectively. The clamping member 200 thus restrains the adjustment screws from further rotation about their respective longitudinal axes, thereby restraining the intonation adjustment structures 148 from further displacement relative to the base 130.

A second clamping member, referred to as a wedge member 210 herein, includes an angled or sloped surface which cooperatively mates with the internal surface 144 of the second side wall 136. As fasteners 212 are inserted through apertures 214A in the wedge member 210 and couple with apertures 214B formed in the second side wall 136, the angled interface between wedge member 210 and the second side wall 136 causes the wedge member 210 to be displaced towards the first side wall 134 thereby compressing all of the string adjustment assemblies 146A-146F between the wedge member 210 (coupled to the first side wall 134) and the second side wall 136. It is noted that, in one embodiment, the apertures may be somewhat oversized relative to the size of the fasteners 212 inserted therethrough. The difference in relative size of the apertures 214A relative to the fasteners 212 enables the wedge member 210 to be displaced laterally (i.e., in a direction towards the first side wall 134) when the fasteners 212 are coupled with the apertures 214B formed in the second side wall 136. In another embodiment, the apertures 214A formed in the wedge member 210 may be configured, for example, as slots which would also enable lateral movement of the wedge member 210 upon assembly of the wedge member 210 with the base 130.

The compressing action provided by the assembly of the wedge member 210 with the base 130 (and more specifically with the second side wall 136) results in a frictional lock between the side surfaces of adjacent adjustment assemblies 146A-146F (i.e., between the side surfaces of adjacent intonation adjustment structures 148 and adjacent height adjustment structures 150) thereby locking the components of the adjustment assemblies 146A-146F from any further movement or displacement relative to the base 130.

Thus, with clamp member 200 and wedge member 210 fastened to the base 130, the adjustment assemblies 146A-146F become fixed relative to the base 130 and relative to each other and are rendered unadjustable until the clamp member 200 and wedge member 210 are removed from, or at least loosened relative to, the base 130.

Furthermore, with the coupling apparatus 112 being rigidly fixed to the body 106 of a musical instrument 100, such as by appropriate fasteners 220, by adhesive or by a combination thereof, the coupling apparatus 112 (including all of its individual components) provides direct and efficient transfer of string energy and vibration to the body 106 of the musical instrument 100 without any substantial damping thereof.

The coupling apparatus 112 of the present invention provides numerous advantages over conventional prior art bridge and tail piece designs. For example, as noted hereinabove, the string contact with the saddle 183 may be maintained for over ¾ of an inch. This increases the stability of the strings 108A-108F as well as the transfer of string energy to the body 106 of the musical instrument 100. Additionally, as can be seen in FIG. 4, there is no kinking or sharp bends in the strings 108A-108F when anchoring the string to the coupling apparatus 112. Such a configuration helps to reduce string breakage.

The solid mass disposed between the strings 108A-108F (e.g., the base 130 and the locked string adjustment assemblies 146A-146F) improves transfer of string energy and vibration to the body 106 of the musical instrument 100 as compared to conventional suspended bridge designs.

As explained herein, the various components of the coupling apparatus 112 lock together into a single rigid component. Such a configuration prevents individual components from vibrating relative to other components or acting as damping mechanisms with regard to string vibrations. Additionally, such a configuration enables adjustment of the individual components within tight tolerances and prevents the individual components from becoming out of adjustment after they have been set. As a result, the coupling apparatus also enables and maintains accurate alignment with the neck 104 and fingerboard 114 of the musical instrument 100.

The incorporation of individual string adjustment assemblies 146A-146F enables the simple adjustment of each string both in terms of height and intonation over a relatively large range independent of every other string. Additionally, the available range of adjustment enables a musician to easily "down tone" the instrument 100 or, in other words, change the tune of the instrument from one key to another key by altering the free length of the strings 108A-108F. Also, the ability to adjust the string height of each string independent of the other stings enables the coupling apparatus 112 to be used with a variety of musical instruments that exhibit different fingerboard radiuses (i.e., the radius of the upper surface of the neck 104 as it traverses from one edge to an opposing edge in a direction substantially parallel to the frets 116).

Thus, the coupling apparatus 112 is amenable to installation on a wide range of musical instruments including solid body and hollow body instruments, instruments incorporating essentially any number of strings, and instruments configured with necks 104 that are "straight" or "pitched back" relative to the body 106 of the musical instrument 100.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. An apparatus for coupling strings to a body of a musical instrument comprising:

a base comprising:

a plate having an upper surface;

a first side wall having a first internal surface;

a second side wall having a second internal surface at an acute angle relative the upper surface of the plate and at least one threaded aperture formed therein through the second internal surface; and an end wall including at least one channel formed therein; and a plurality of adjustment assemblies, each of the plurality of adjustment assemblies abutting at least one other adjustment assembly of the plurality of adjustment assemblies and each adjustment assembly of the plurality comprising:

a first structure disposed on the upper surface of the plate;

a second structure slidably coupled with the first structure, a surface of the second structure defining a saddle for a string;

a first adjustment screw threadably coupled to the first structure and the end wall, the first adjustment screw positioned and configured to displace the first structure relative the end wall along a first axis upon rotation of the first adjustment screw; and a second adjustment screw disposed between and coupled to the first structure and the second structure, the second adjustment screw positioned and configured to slidably displace the second structure relative to the first structure upon rotation thereof; and a wedge member having a sloped surface and at least one aperture therethrough; and wherein the sloped surface of the wedge member abuts the second internal surface of the second side wall and at least one third adjustment screw extends through the at least one aperture of the wedge and threadably couples with the at least one threaded aperture formed in the second side wall and the wedge member; and wherein each of the plurality of adjustment assemblies is at least partially disposed between the first side wall and the wedge member, the first internal surface of the first side wall abuts one of the plurality of adjustment assemblies and the wedge member abuts another one of the plurality of adjustment assemblies.

2. The apparatus of claim 1, wherein the base further comprises a clamping member releasably coupled with the end wall.

3. The apparatus of claim 2, wherein the plate, the first side wall, the second side wall and the end wall are an integral unit.

4. The apparatus of claim 3, wherein the integral unit is aluminum or an aluminum alloy.

5. The apparatus of claim 2, wherein the clamping member is positioned relative the portion of the first adjustment screw disposed within the channel so as to restrict movement of the first adjustment screw in a direction along the first axis.

6. The apparatus of claim 1, wherein the plurality of adjustment assemblies are compressed against one another and compressed against the wedge member and the first side wall.

7. The apparatus of claim 1, wherein the first structure and the second structure are cooperatively positioned and configured such that the position of the first structure relative the end wall effects a free length of a string contacting the saddle.

8. The apparatus of claim 7, wherein the first structure and the second structure are cooperatively positioned and configured such that the position of the second structure relative to the first structure effects a height of the saddle relative to the base.

9. The apparatus of claim 1, wherein the second structure is slidingly interlocked with the first structure such that the second structure is slidably displaceable relative to the first structure.

10. The apparatus of claim 1, wherein the plurality of adjustment assemblies comprise at least four adjustment assemblies.

11. A musical instrument comprising:

a headstock;

a neck coupled with the headstock, a surface of the neck defining a fingerboard;

a body coupled with the neck;

at least one string extending between the headstock and the body; and a coupling apparatus disposed on a portion of the body and coupled to the at least one string, the coupling apparatus comprising:

a base comprising:

a plate having an upper surface;

a first side wall having a first internal surface;

a second side wall having a second internal surface at an acute angle relative the upper surface of the plate and at least one threaded aperture formed therein through the second internal surface; and an end wall including at least one channel formed therein; and a plurality of adjustment assemblies, each of the plurality of adjustment assemblies abutting at least one other adjustment assembly of the plurality of adjustment assemblies and each adjustment assembly of the plurality of adjustment assemblies comprising:

a first structure disposed on the upper surface of the plate;

a second structure slidably coupled with the first structure, a surface of the second structure defining a saddle for a string;

a first adjustment screw threadably coupled to the first structure and the end wall, the first adjustment screw positioned and configured to displace the first structure relative the end wall along a first axis upon rotation of the first adjustment screw; and a second adjustment screw disposed between and coupled to the first structure and the second structure, the second adjustment screw positioned and configured to slidably displace the second structure relative to the first structure upon rotation thereof; and a wedge member having a sloped surface and at least one aperture therethrough; and wherein the sloped surface of the wedge member abuts the second internal surface of the second side wall and at least one third adjustment screw extends through the at least one aperture of the wedge and threadably couples with the at least one threaded aperture formed in the second side wall and the wedge member; and wherein each of the plurality of adjustment assemblies is at least partially disposed between the first side wall and the wedge member, the first internal surface of the first side wall abuts one of the plurality of adjustment assemblies and the wedge member abuts another one of the plurality of adjustment assemblies.

12. A method of adjusting at least one string on a stringed musical instrument, the method comprising:

disposing a portion of the at least one string over a saddle defined in a surface of at least one adjustment assembly of a plurality of adjustment assemblies;

adjusting a height of the at least one string relative to a base by displacing a second structure of the at least one adjustment assembly relative to a first structure;

adjusting a free length of the at least one string by displacing the first structure and the second structure along a first axis; and compressing the at least one adjustment assembly against at least another adjustment assembly of the plurality of adjustment assemblies and compressing the plurality of adjustment assemblies between a first side wall and a wedge member by selectively and adjustably applying a force to the wedge member to displace a sloped surface of the wedge member along an acutely angled surface of a second side wall to displace the wedge member toward the plurality of adjustment assemblies and the first side wall.

13. The method according to claim 12, wherein displacing the second structure relative to the first structure further includes rotating a first adjustment screw disposed between the first structure and the second structure to displace the second structure relative to the first structure.

14. The method according to claim 13, wherein displacing the first structure and the second structure along a first axis further includes rotating a second adjustment screw, and wherein the method further comprises applying a force to a clamping member to restrain the rotation of the second adjustment screw after displacing the first and second structure to a desired position along the first axis.

* * * * *

UNITED STATES PATENT AND TRADEMARK OFFICE

CERTIFICATE OF CORRECTION

PATENT NO. : 7,638,697 B2
APPLICATION NO. : 11/266807
DATED : December 29, 2009
INVENTOR(S) : Kevin S. Moore It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 242 days.

In the drawings:

| | |
|---|---|
| **FIG. 4** | change the lowermost occurrence of reference numeral "170" to --172-- |

In the specification:

| | | |
|---|---|---|
| COLUMN 1, | LINE 43, | change "solid body" to --solid-body-- |
| COLUMN 8, | LINE 19, | after "apertures" and before "may" insert --214A, 214B-- |
| COLUMN 9, | LINES 27, 28 | change "solid body and hollow body" to --solid-body and hollow-body-- |

Signed and Sealed this

Fifth Day of October, 2010

David J. Kappos

David J. Kappos
*Director of the United States Patent and Trademark Office*